US008540391B2

(12) United States Patent
Mostoller et al.

(10) Patent No.: US 8,540,391 B2
(45) Date of Patent: Sep. 24, 2013

(54) LIGHT EMITTING DIODE INTERCONNECTION SYSTEM

(75) Inventors: Matthew Edward Mostoller, Hummelstown, PA (US); Ricky Edward Brown, Lykens, PA (US); Christopher George Daily, Harrisburg, PA (US); Rohan Narang, Harrisburg, PA (US); Robert D. Rix, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 158 days.

(21) Appl. No.: 12/818,814

(22) Filed: Jun. 18, 2010

(65) Prior Publication Data

US 2011/0310628 A1 Dec. 22, 2011

(51) Int. Cl.
*F21V 21/00* (2006.01)

(52) U.S. Cl.
USPC ..... 362/217.17; 362/249.02; 362/217.14; 362/217.15; 362/217.16; 362/800; 439/43; 439/52; 439/113; 439/207; 439/378

(58) Field of Classification Search
USPC .. 362/252, 373, 800, 249.02, 217.14–217.17, 362/43–48, 52, 53, 113–115, 119, 151, 207–213, 362/374, 378–381, 485, 487, 515, 525–526, 362/604–606, 620.01, 620.02, 620.21–620.25; 439/43–48, 52, 53, 113–115, 119, 151, 207–213, 439/374, 378–381, 485, 487, 515, 525–526, 439/604–606, 620.01, 620.02, 620.21–620.25
See application file for complete search history.

(56) References Cited

U.S. PATENT DOCUMENTS

| | | | | |
|---|---|---|---|---|
| 6,932,495 | B2 * | 8/2005 | Sloan et al. | 362/294 |
| 2004/0115984 | A1 * | 6/2004 | Rudy et al. | 439/405 |
| 2005/0207151 | A1 * | 9/2005 | Aanegola et al. | 362/227 |
| 2007/0190845 | A1 * | 8/2007 | Mrakovich et al. | 439/404 |

* cited by examiner

*Primary Examiner* — William Carter

(57) ABSTRACT

A light emitting diode (LED) interconnection system is provided. The system includes a cable having a driver end and a termination end. The cable has conductive pathways extending between the driver end and the termination end. The driver end is configured to engage a driver to carry an electrical current to the conductive pathways. The termination end is configured to terminate the conductive pathways. A connector is provided having a cable contact and a LED contact joined to the cable contact. The cable contact pierces the cable and engages the conductive pathways to electrically join the connector to the conductive pathways. A LED board is provided having a circuit board including circuit board contacts. A LED is positioned on the circuit board and electrically joined to the circuit board contacts. The LED contact of the connector engages the circuit board contacts to electrically join the connector to the LED.

19 Claims, 15 Drawing Sheets

LIGHT EMITTING DIODE INTERCONNECTION SYSTEM

BACKGROUND OF THE INVENTION

The subject matter described herein relates generally to solid state lighting systems and, more particularly, to a light emitting diode (LED) interconnection system.

Solid state light systems generally include a LED soldered to a circuit board. The circuit board is configured to be mounted in a lighting fixture. The lighting fixture includes a power source to provide power to the LED. The circuit board is wired to the lighting fixture power source. The circuit board may be wired to the lighting fixture using wires that are soldered to the circuit board and the fixture. Alternatively, the circuit board may be wired to the fixture using multiple connectors that extend between the circuit board and the fixture. Generally, wiring the circuit board to the light fixture power source requires several wires and/or connectors. Each wire and connector must be individually joined between the circuit board and the lighting fixture. Electrically engaging the wires and connectors enables the power source to carry an electrical current to the LED.

However, solid state lighting systems are not without disadvantages. Wiring the circuit board with multiple connectors and/or multiple wires generally requires a significant amount of space. In fixtures where space is limited, the wires and connectors may require additional time to connect. Additionally, having multiple wires to connect requires multiple terminations, increasing the time required to connect the LEDs. Moreover, using multiple wires and connectors increases the possibility of mis-wiring the lighting system. In particular, LED light fixtures are frequently installed by unskilled labor, thereby increasing the possibility of mis-wiring. Mis-wiring the lighting system may result in substantial damage to the LED. Also, in a system where wires are soldered between the circuit board and the fixture, the wires become difficult to replace and/or rewire. Specifically, the soldering must be removed from the wires prior to replacing and/or rewiring the wires. This may damage the LED. Generally. LEDs are expensive to replace.

A need remains for a solid state lighting system that reduces the need to connect multiple wires and/or connectors.

SUMMARY OF THE INVENTION

In one embodiment, a light emitting diode (LED) assembly is provided. The assembly includes a connector having a LED end and a cable end. The connector includes electrical contacts having a cable contact and a LED contact. The cable contacts are positioned on the cable end of the connector and configured to terminate a cable and electrically connect to a power pathway of the cable. The LED contacts are positioned on the LED end of the connector. A LED circuit board is provided having circuit board contacts. The LED circuit board is configured to engage the LED end of the connector so that the LED contacts of the connector electrically engage the circuit board contacts of the LED circuit board. A LED is mounted on the LED circuit board. The LED is electrically coupled to the circuit board contacts of the LED circuit board. The circuit board contacts and the electrical contacts of the connector form electrical pathways between the connector and the LED. A first electrical pathway is configured to direct an electrical current from the power pathway of the cable to the LED. A second electrical pathway is configured to direct the electrical current from the LED back to the power pathway of the cable.

In another embodiment, a light emitting diode (LED) interconnection system is provided. The system includes a cable having a driver end and a termination end. The cable has power pathways and return pathways extending between the driver end and the termination end. The driver end is configured to engage a driver to carry an electrical current to the power pathways. The termination end is configured to join the power pathways and the return pathways and configured to return the electrical current to the driver. A connector is provided having a cable contact and a LED contact joined to the cable contact. The cable contact terminates the cable and electrically connects to the power pathways to carry the electrical current to the LED contact. A LED assembly is provided having circuit board contacts joined to a LED. The LED contact of the connector engaging the circuit board contacts of the LED assembly to carry the electrical current to the LED.

In another embodiment, a light emitting diode (LED) interconnection system is provided. The system includes a driver configured to produce an electrical current. A cable is provided having a driver end and a termination end. The cable has power pathways extending between the driver end and the termination end. The driver end engages the driver to carry the electrical current to the power pathways. A connector is provided having a LED end and a cable end. The connector includes electrical contacts having a cable contact and a LED contact. The cable contacts are positioned on the cable end of the connector to terminate the cable and electrically connect to the power pathways of the cable. The LED contacts are positioned on the LED end of the connector. A LED circuit board is provided having circuit board contacts. The LED circuit board engages the LED end of the connector so that the LED contacts of the connector electrically engage the circuit board contacts of the LED circuit board. A LED is mounted on the LED circuit board. The LED is electrically coupled to the circuit board contacts of the LED circuit board. The circuit board contacts and the electrical contacts of the connector form electrical pathways between the connector and the LED. A first electrical pathway directs the electrical current from the power pathway of the cable to the LED. A second electrical pathway directs the electrical current from the LED back to the power pathway of the cable.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
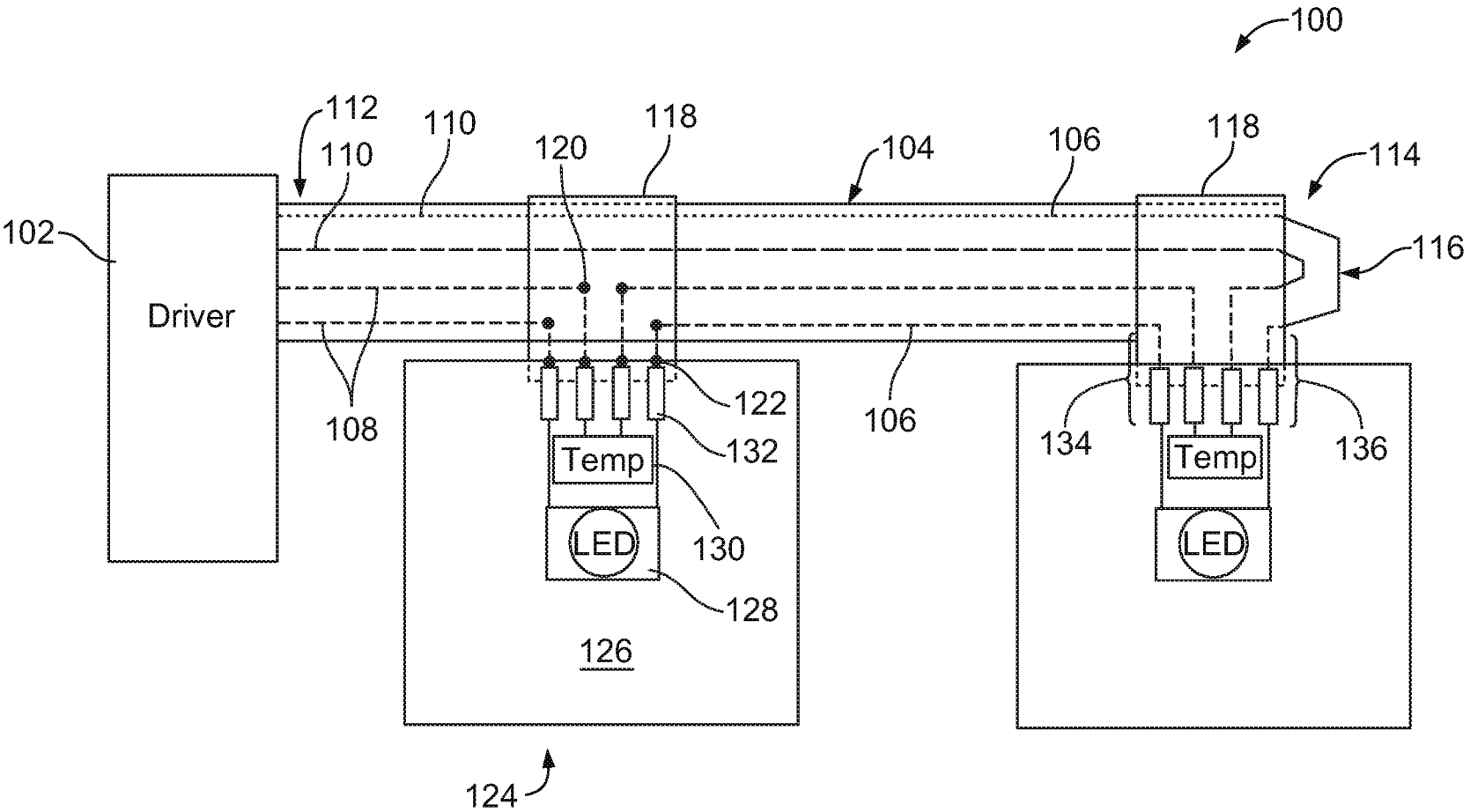
FIG. 1 is a schematic view of a light emitting diode (LED) interconnection system formed in accordance with an embodiment.

FIG. 1 is a schematic view of a light emitting diode (LED) interconnection system 100 for a solid state lighting system. The system 100 includes a driver 102 that provides power for the system 100. In the exemplary embodiment, the driver 102 provides power as an electrical current. The driver 102 may include a circuit board that carries the electrical current throughout the system 100. A cable 104 is electrically joined to the driver 102. The cable 104 includes a driver end 112 and a termination end 114. The driver end 112 of the cable 104 is joined to the driver 102. In the illustrated embodiment, the cable 104 is a ribbon cable having conductive pathways 106. The conductive pathways 106 are configured to carry the electrical current through the system 100. The conductive pathways 106 include power pathways 108 and return pathways 110. The illustrated embodiment shows two power pathways 108 and two corresponding return pathways 110. Alternatively, the system 100 may have only one power pathway 108 and one corresponding return pathway 110. In another embodiment, the system may include any number of power pathways 108 and corresponding return pathways 110. The power pathways 108 carry the electrical current from the driver to the termination end 114 of the cable 104. A termination circuit 116 is provided at the termination end 114 of the cable 104. The termination circuit 116 joins the power pathways 108 and the return pathways 110. The return pathways carry the electrical current back to the driver 102 to complete an electrical circuit throughout the system 100.

At least one connector 118 is coupled to the cable 104 between the driver end 112 and the termination end 114 of the cable 104. In an exemplary embodiment, the connector 118 is an insulation displacement connector. The connector 118 includes cable contacts 120 and LED contacts 122. The cable contacts 120 are joined to the LED contacts 122. In one embodiment, the cable contacts 120 and the LED contacts 122 may be integrally stamped and formed. The cable contacts 120 pierce the cable and electrically engage the power pathways 108. The cable contacts 120 carry the electrical current to the LED contacts 122.

A LED board 124 is coupled to the connector 118. The LED board 124 includes a circuit board 126 having a LED 128 and a temperature sensor 130 joined thereto. The temperature sensor 130 measures the temperature of the LED board 124 to detect whether the LED board 124 is overheating. Optionally, the LED board 124 may not include a temperature sensor 130. The LED board 124 also includes circuit board connectors 132 electrically engaging the LED 128 and the temperature sensor 130. The LED contacts 122 of the connector 118 are configured to electrically engage the circuit board connectors 132 of the LED board 124. The circuit board connectors 132 carry power from the power pathways 108 to the LED 128 and the temperature sensor 130. One power pathway 130 carries power to the LED 128 and the other power pathway 130 carries power to the temperature sensor 130. In an embodiment that does not include a temperature sensor 130, the system 100 may only require one power pathway 108 and one return pathway 110. In the illustrated embodiment, the power pathways 108 are spliced with the connector 118 to direct the electrical current along an electrical input pathway 134 from the power pathway 108 to the LED 128 and the temperature sensor 130. The electrical current then exits the LED 128 and the temperature sensor along an electrical output pathway 136. The output path 136 channels the electrical current from the LED 128 and the temperature sensor 130 back to the power pathway 108. The electrical input pathway 134 and the electrical output pathway 136 connected to the LED 128 are illustrated as being positioned outside the electrical input pathway 134 and the electrical output pathway 136 connected to the temperature sensor 130. It should be noted that the electrical input pathway 134 and the electrical output pathway 136 connected to the LED 128 may be positioned inside the electrical input pathway 134 and the electrical output pathway 136 connected to the temperature sensor 130.

Figure 2:
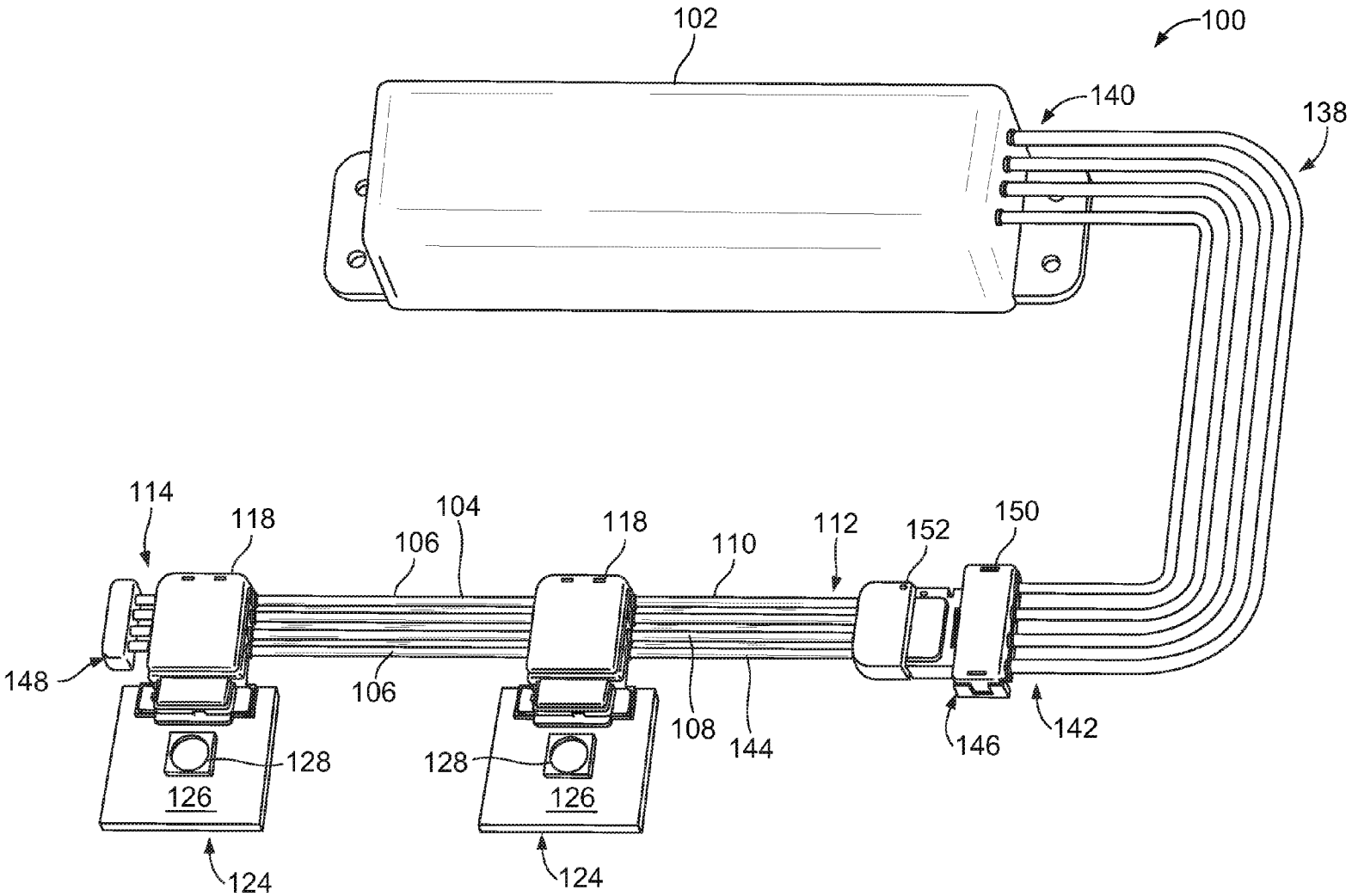
FIG. 2 is a top perspective view of a portion of the system shown in FIG. 1 and formed in accordance with an embodiment.

FIG. 2 is a view of an embodiment of the system 100. The components of FIG. 2 that are the same as the components of FIG. 1 are labeled using the same reference numbers. The driver 102 includes wires 138 extending therefrom. The wires 138 are configured to carry the electrical current. The wires 138 include a driver end 140 and a mating end 142. The driver end 140 of each wire 138 is joined to the driver 102. The mating end 142 of each wire 138 is joined to the driver end 112 of the cable 104. The cable 104 is illustrated as a ribbon cable having a insulation 144. The insulation 144 encloses and insulates the power pathways 108 and the return pathways 110. The cable 104 and the wires 138 are joined with a wire-to-wire plug assembly 146.

The wire-to-wire plug assembly 146 includes a first connector 150 and a second connector 152. In an exemplary embodiment, the first connector 150 is configured as a jack and the second connector 152 is configured as a plug. Alternatively, the first connector 150 may be configured as a plug and the second connector 152 may be configured as a jack. The mating end 142 of each wire 138 is coupled to the first connector 150 of the wire-to-wire plug assembly 146. The driver end 112 of the cable 104 is joined to the second connector 152. The first connector 150 is configured to engage the second connector 152 to mate the wires 138 and the cable 104. Connectors 118 are joined to the cable 108. The connectors 118 provide the electrical current to LED boards 124 to power the LEDs 128. A cable terminator 148 is provided on the termination end 114 of the cable 104. The cable terminator 148 includes the termination circuit 116 to join the power pathways 108 and the return pathways 110.

Figure 3:
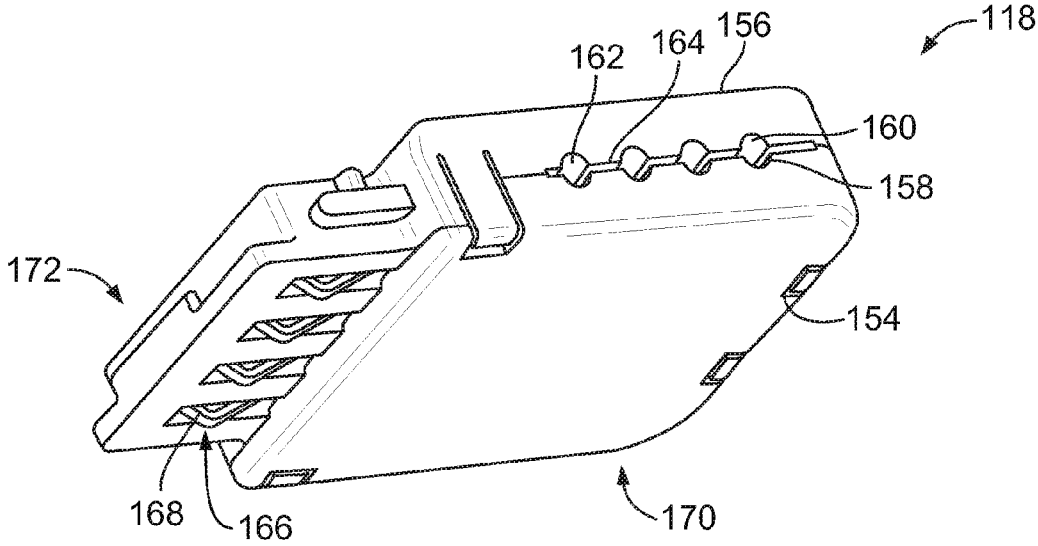
FIG. 3 is a top perspective view of a connector formed in accordance with an embodiment.

FIG. 3 illustrates a connector 118. The connector 118 includes a housing 154 and a stuffer 156 coupled to the housing 154. The housing 154 may joined to the stuffer 156 with latches, notches, or the like. Alternatively, the housing 154 may be press-fit to the stuffer 156. In other embodiments, the housing 154 may be coupled to the stuffer 156 using any other suitable connection means. The connector 118 includes a cable end 170 and a LED end 172. The cable end 170 of the housing 154 includes recesses 158 formed therein. The cable end 170 of the stuffer 156 also includes recesses 160. When the stuffer 156 is joined to the housing 154, the recesses 158 align with the recesses 160 to form openings 162 in the cable end 170 of the connector 118. Adjacent openings 162 are joined by slots 164 formed between the housing 154 and the stuffer 156. The slots 164 and the openings 162 are configured to receive the cable 104. The openings 162 receive the conductive pathways 106 of the cable.

The LED end 172 of the connector 118 includes electrical contacts 166. The electrical contacts 166 include a LED contact 168. The LED contacts 168 extend from the LED end 172 of the connector 118. The LED contacts 168 are configured to engage the circuit board 126 of the LED board 124. The LED contacts 168 are configured to provide power to the LED 128. In one embodiment, the LED contacts 168 are formed as springs. The springs provide pressure on the circuit board 126 to electrically engage the circuit board 126. Alternatively, the LED contacts 168 may be configured to solder to the circuit board 126.

Figure 4:
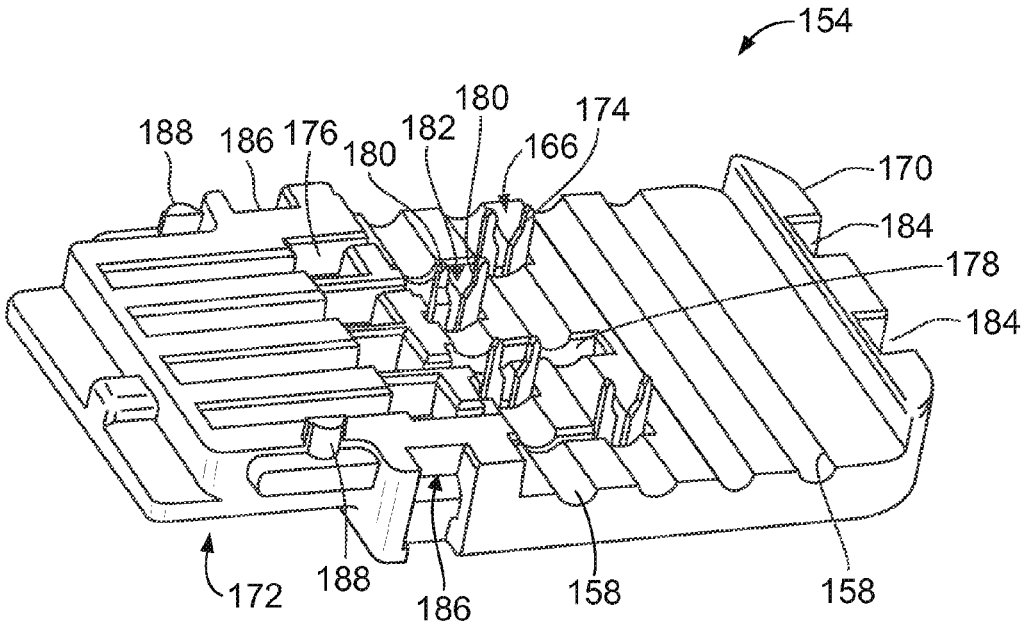
FIG. 4 is a top perspective view of the connector housing shown in FIG. 3.
Figure 5:
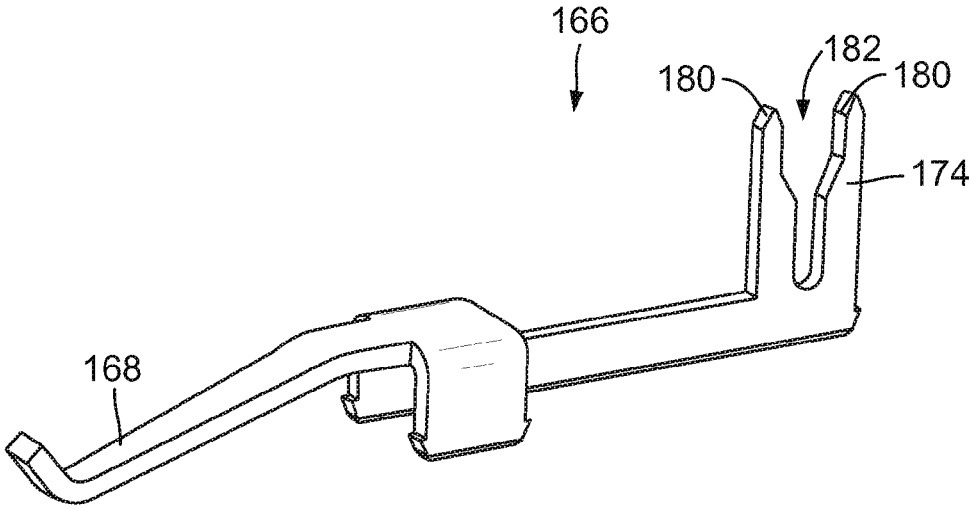
FIG. 5 is a top perspective view of the electrical contact shown in FIG. 3.

FIG. 4 illustrates the connector housing 154. The housing 154 is formed from an electrically insulative material. The cable end 170 of the connector housing 154 includes the recesses 158. The electrical contacts 166 extend into the recesses 158. The electrical contacts 166 include a cable contact 174. The cable contact 174 may be formed integrally with the LED contacts 168 of the electrical contacts 166, as illustrated in FIG. 5. The cable contact 174 includes prongs 180 having a gap 182 therebetween. The cable contacts 174 extend from the recesses 158. The LED contacts 168 extend through slots 176 formed in the LED end 172 of the connector housing 154. The prongs 180 of the cable contacts 174 are configured to pierce the insulation 144 of the cable 104 and engage the power pathways 108 of the cable 104. The power pathway 108 is received within the gap 182 between the prongs 180. Alternatively, the cable contact 174 may include only one prong 180 that pierces the power pathway 108. The cable contacts 174 are configured to channel the electrical current to the LED contact 168 to provide power to the LED 128. An opening 178 is formed in the cable end 170 of the connector housing 154. The opening 178 extends through two of the recesses 158. The opening 178 is configured to receive a wire bisector (not shown) that is configured to bisect the power pathways 108.

The cable end 170 of the housing 154 includes notches 184 formed therein. The notches 184 are configured to be engaged by the stuffer 156 to retain the stuffer 156 on the housing 154. Optionally, the cable end 170 of the housing 154 may include latches to engage the stuffer. The LED end 172 of the housing 154 also includes notches 186. The notches 186 are configured to be engaged by the LED end 172 of the stuffer 156. Alternatively, the LED end 172 of the housing 154 may include latches to engage the stuffer 156. In another embodiment, the stuffer 156 and the housing 154 may be press-fit together with pins and apertures formed on the stuffer 156 and the housing 154. Alignment tabs 188 are provided on the LED end 172 of the housing 154. The alignment tabs 188 engage the LED end 172 of the stuffer 156 to align the stiffer 156 with respect to the housing 154 when the stuffer 156 and the housing 154 are joined.

Figure 6:
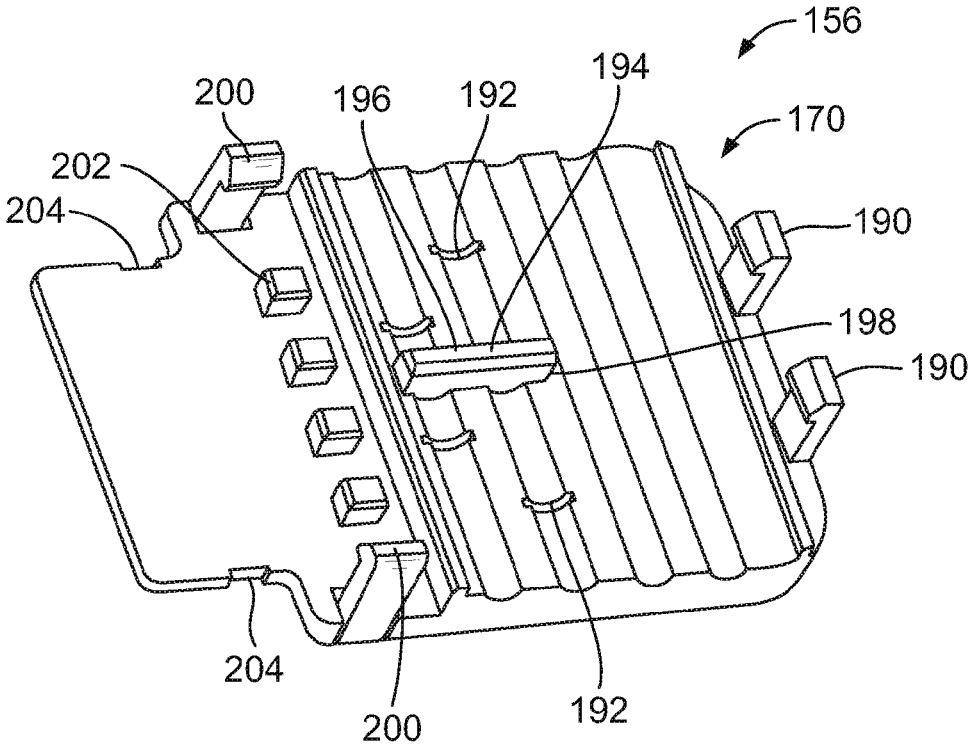
FIG. 6 is a bottom perspective view of the connector stuffer shown in FIG. 3.

FIG. 6 illustrates the stuffer 156. The stuffer 156 is formed from an electrically insulative material. The cable end 170 of the stuffer 156 includes latches 190 that are configured to mate with the notches 184 formed in the housing 154. Alternatively, the cable end 170 may include notches configured to receive latches formed on the housing 154. Slots 192 are provided within the recesses 160. When the stuffer 156 is mated to the housing 154, the cable contacts 174 of the housing 154 engage the power pathways 108 of the cable 104 and are received within the slots 192. The slots 192 enable the cable contacts 174 to entirely engage the power pathways 108.

A wire bisector 194 extends from the stuffer 156. The wire bisector 194 is formed integrally with the stuffer 156. Alternatively, the wire bisector 194 may be formed separately and configured to be inserted into the stuffer 156. When the stuffer 156 is coupled to the housing 154, the wire bisector 194 splices the power pathways 108 and is received in the opening 178 of the housing 154. The wire bisector 194 splices the power pathways 108 so that the electrical current in the power pathways 108 is directed to and from the LED contacts 168 of the connector 118. In an alternative embodiment, the power pathways 108 may be pre-bisected prior to the cable 104 being inserted into the connector 240. The wire bisector 194 may be formed from an electrically insulative material, for example, plastic. Alternatively, a tip 196 of the wire bisector 194 may be formed from metal and a body 198 of the wire bisector may be formed from an electrically insulative material. The metal tip 196 is configured to splice the power pathways 108. After the stuffer 156 is fully engaged with the housing 154, the metal tip 196 rests within the opening 178 where the metal tip 196 does not make contact with the power pathways 108. In this position, the insulated body 198 of the wire bisector 194 abuts the power pathways 108 to insulate the power pathways 108 and direct the electrical current to the LED contact 168. In another embodiment, the entire wire bisector 194 is formed from metal. The wire bisector 194 is coated with a dielectric material to insulate the wire bisector.

The LED end 172 of the stuffer 156 includes latches 200. The latches 200 are configured to engage the notches 186 formed on the housing 154 to retain the stuffer 156 on the housing 154. Alternatively, the LED end 172 of the stuffer 156 may include notches configured to receive latches formed on the housing 154. Protrusions 202 extend from the LED end 172 of the stuffer 156. The protrusions 202 are configured to be received within the slots 176 of the housing 154. The protrusions press against the LED contacts 168 positioned within the slots 176 to provide a spring force to the LED contacts 168. The LED end 172 of the stuffer also includes alignment notches 204. The alignment notches 204 are configured to receive the alignment tabs 188 of the housing 154 to align the stuffer 156 with respect to the housing 154.

Figure 7:
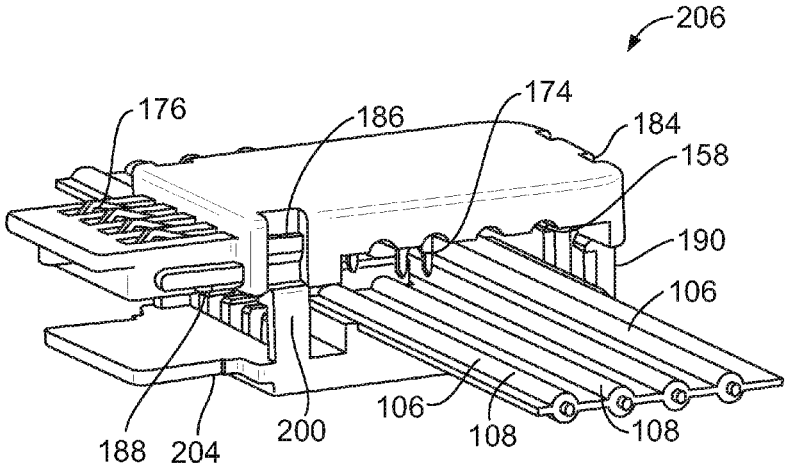
FIG. 7 is a top perspective view of a connector and a cable formed in accordance with an embodiment and in a preassembled position.
Figure 8:
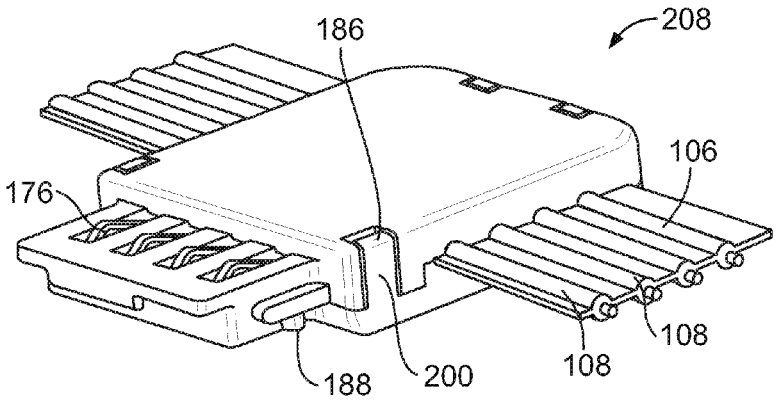
FIG. 8 is a top perspective view of the connector and the cable shown in FIG. 7 and in an assembled position.

FIG. 7 illustrates the connector 118 and the cable 104 in a preassembled position 206. FIG. 8 illustrates the connector 118 and the cable 104 in an assembled position 208. The cable 104 is positioned between the connector housing 154 and the connector stuffer 156. The cable 104 is positioned so that the conductive pathways 106 are aligned with the recesses 158 and 160, as illustrated in FIG. 7. The cable contacts 174 are aligned with the power pathways 108. The latches 190 and 200 align with the notches 184 and 186, respectively. The alignment tabs 188 are aligned with the alignment notches 204. When the stuffer 156 is engaged with the housing 154, the cable contacts 174 pierce the insulation 144 of the cable 104 and engage the power pathways 108 to direct the electric current to the LED contacts 168. The latches and 200 engage with the notches 184 and 186, respectively, to retain the stuffer 156 on the housing 154.

Figure 9:
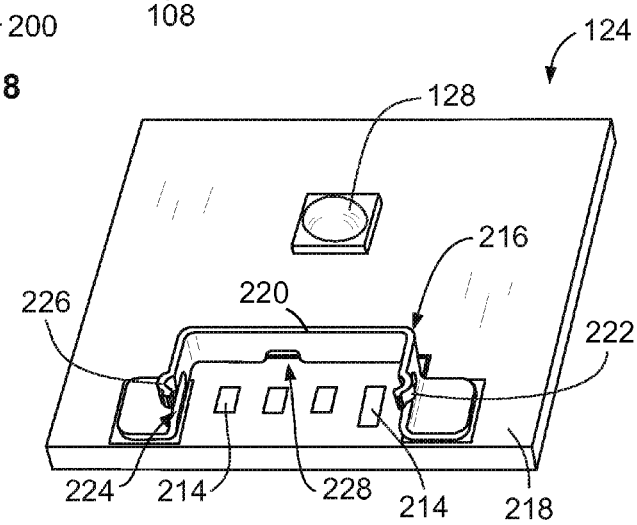
FIG. 9 is a top perspective view of a LED board formed in accordance with an embodiment.

FIG. 9 illustrates the LED board 124. The LED board 124 includes circuit board contacts 214. The LED board 124 includes circuit board contacts 214 (shown in FIG. 9) positioned on an end 218 of the LED board 124. The circuit board contacts 214 are electrically joined to the LED 128. The circuit board contacts 214 may be formed as conductive pads. The circuit board contacts 214 are configured to engage the LED contacts 168 of the connector 118 to direct the electrical current to the LED 128.

The LED board also includes an engagement mechanism 216 positioned on an end 218 of the LED board 124. The engagement mechanism 216 is configured to couple to the connector 118. The engagement mechanism 216 is surface mounted to the LED board 214. The engagement mechanism 216 may be soldered, press-fit, or otherwise coupled to the LED board 124. The engagement mechanism 216 surrounds the circuit board contacts 214. The engagement mechanism 216 includes a center panel 220 and clips 222 extending from the center panel 220. The center panel 220 has an alignment opening 228 extending therethrough. The clips 222 form slots 224. The clips 222 also include a latch 226.

Figure 10:
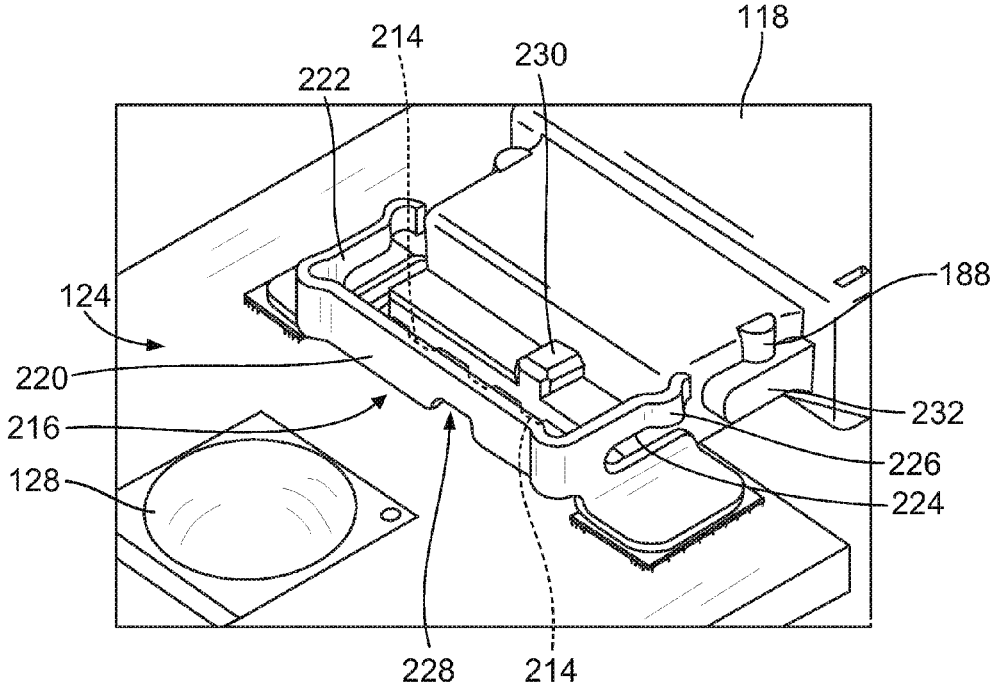
FIG. 10 is a top perspective view of a connector and a LED board formed in accordance with an embodiment and in a preassembled position.
Figure 11:
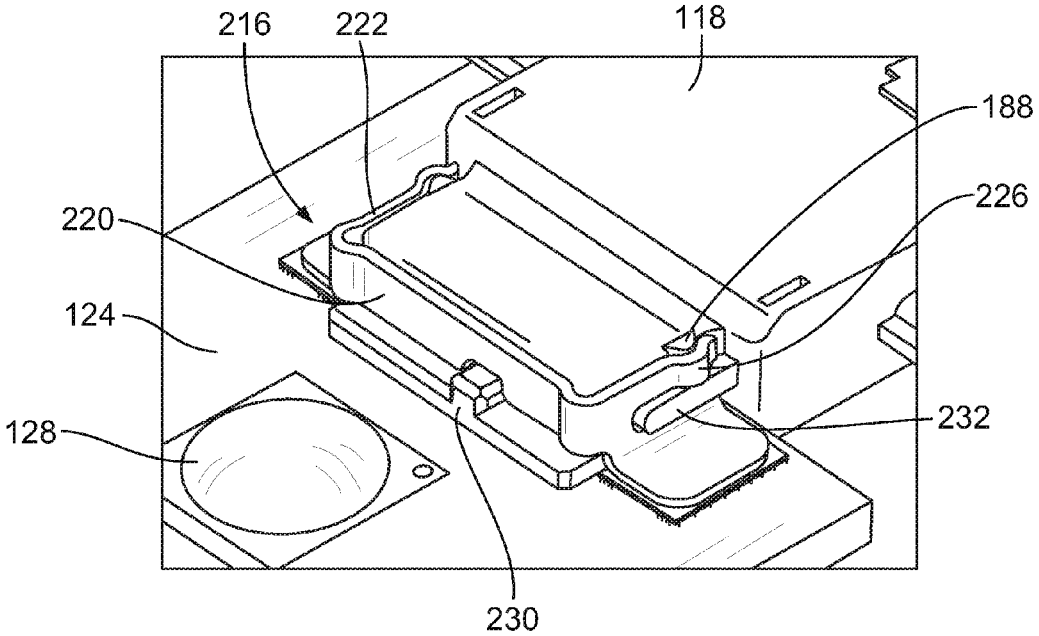
FIG. 11 is a top perspective view of the connector and the LED board shown in FIG. 10 and in an assembled position.

FIG. 10 illustrates the connector 118 and the LED board 124 in a preassembled position 210. FIG. 11 illustrates the connector 118 and the LED board 124 in an assembled position 212. The connector 118 is coupled to the LED board to provide power to the LED 128. The connector 118 includes an alignment tab 230 positioned on the housing 154 of the connector 118. The alignment tab 230 is sized for the opening 228 in the center panel 220. When the connector 118 is joined to the LED board 124, the alignment tab 130 is received within the opening 228 to align the LED contacts with the circuit board contacts 214. Alignment tabs 232 are also provided on the connector housing 154. The alignment tabs 232 position within the slots 224 formed by the clips 222 of the engagement mechanism 216. The alignment tabs 232 further align the connector 118 with respect to the LED board 124. The alignment tabs 188 of the connector 118 are shaped to correspond to the shape of the latches 226 formed on the clips 222 of the engagement mechanism 216. The latches 226 lock to the alignment tabs 188 when the connector 118 is joined to the LED board 124 to retain the connector 118 to the LED board 124.

Figure 12:
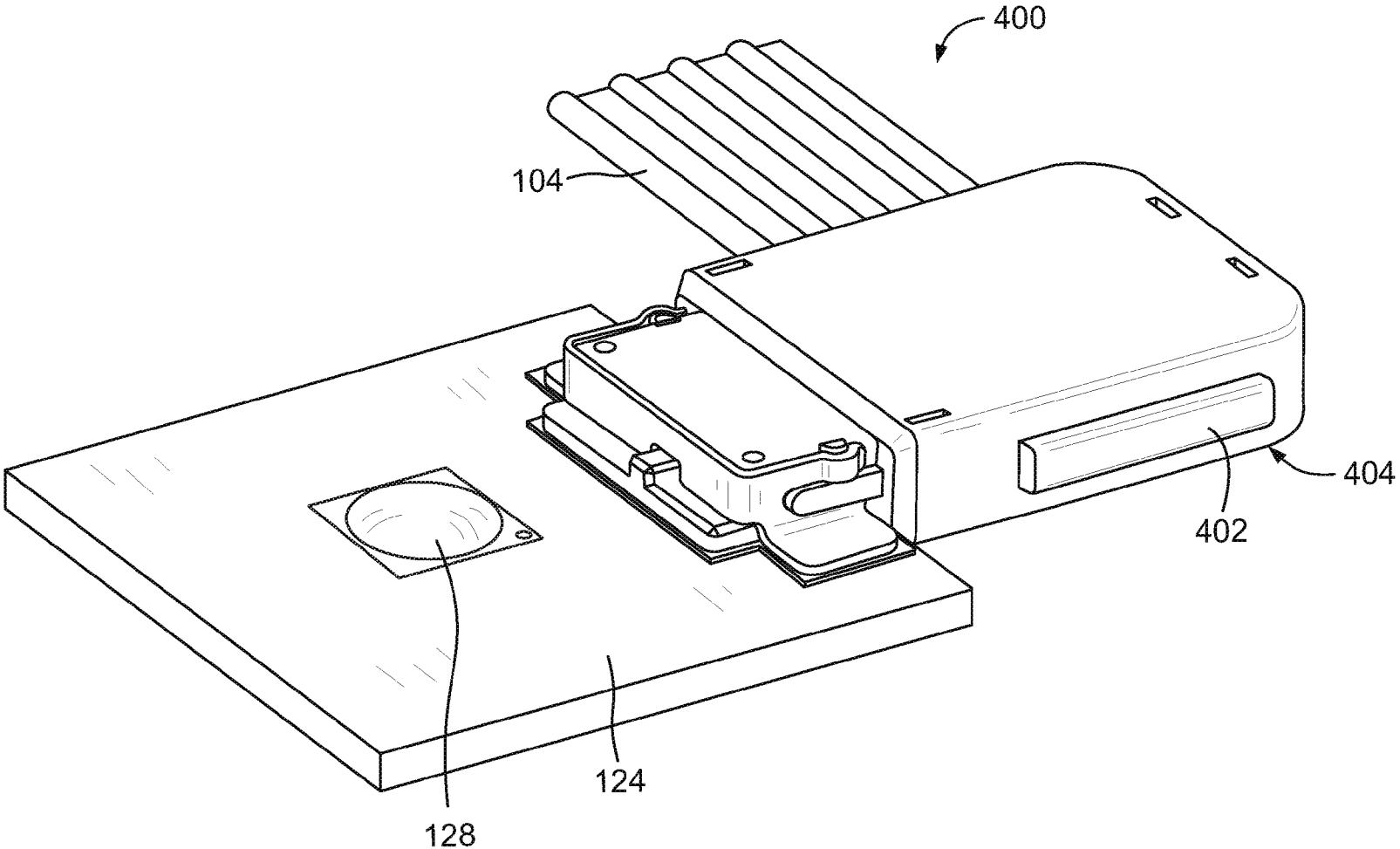
FIG. 12 is a top perspective view of an alternative embodiment of a connector formed in accordance with an embodiment and coupled to a LED board.

FIG. 12 illustrates a connector 400. The connector 400 is configured to engage the cable 104 and the LED board 124. The connector 400 includes the same components as the connector 118. The connector 400 also includes a cable terminator 402 having the cable termination circuit 116 therein. The cable terminator 402 is inserted into a side 404 of the connector 400 opposite the cable 104. The cable terminator 402 joins the power pathways 108 and the return pathways 110 to return the electrical current to the driver 102.

Figure 13:
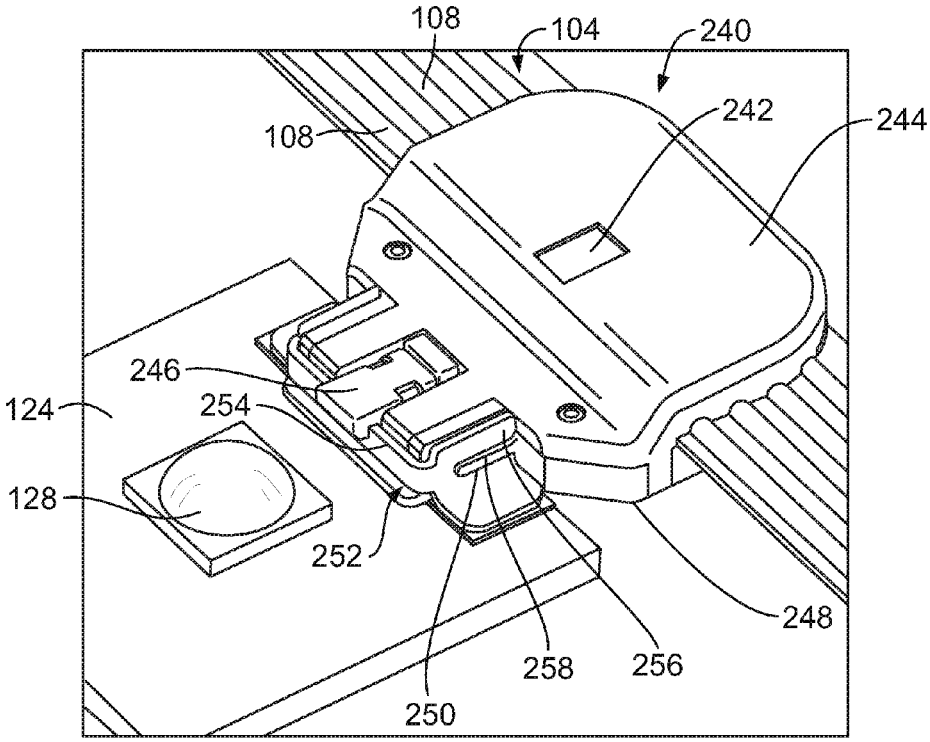
FIG. 13 is a top perspective view of an alternative embodiment of a connector formed in accordance with an embodiment and coupled to a LED board.

FIG. 13 illustrates an alternative connector 240 coupled to the LED board 124. The connector 240 is joined to the LED board 124 to provide power to the LED 128. The connector 240 includes a connector stuffer 244 that receives a wire bisector 242 in an opening (not shown) formed therein. The wire bisector 242 is configured to splice the power pathways 108 of the cable 104 to redirect the power pathways 108 to and from the LED board 124. The stuffer 244 also includes a latch 246 extending therefrom. The connector 240 includes a housing 248 coupled to the stuffer 244. The housing 248 has alignment tabs 250 extending therefrom.

The LED board 124 includes an engagement mechanism 252 positioned thereon. The engagement mechanism 252 includes a center panel 254 and flanges 256 extending therefrom. The flanges 256 form slots 258. The slots 258 receive the alignment tabs 250 of the connector 240 to align the connector 240 with respect to the LED board 124. The latch 246 of the connector 240 engages the center panel 254 of the engagement mechanism 252 to lock the connector 240 onto the LED board 124.

Figure 14:
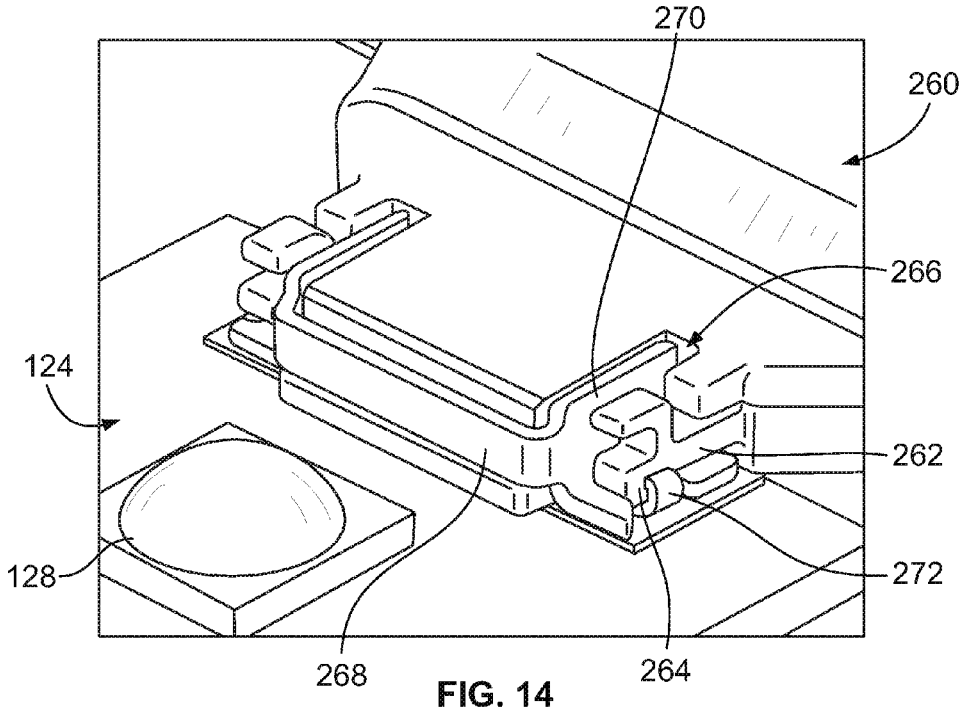
FIG. 14 is a top perspective view of another embodiment of a connector formed in accordance with an embodiment and coupled to a LED board.

FIG. 14 illustrates another connector 260 coupled to the LED board 124. The connector 260 joins to the LED board 124 to provide power to the LED 128. The connector 260 includes a latch 262 having a hook 264. The latch 262 extends from the connector 260 and forms a slot 266. The LED board 124 includes an engagement mechanism 268 having flanges 270. A hook 272 extends from the flanges 270. The flanges 270 rest within the slot 266 formed by the latch 262 of the connector 260. The flanges 270 rest within the slot 266 to align the connector 260 with the LED board 124. The hook 264 of the latch 262 locks with the hook 272 of the engagement mechanism 268 to lock the connector 260 to the LED board 124.

Figure 15:
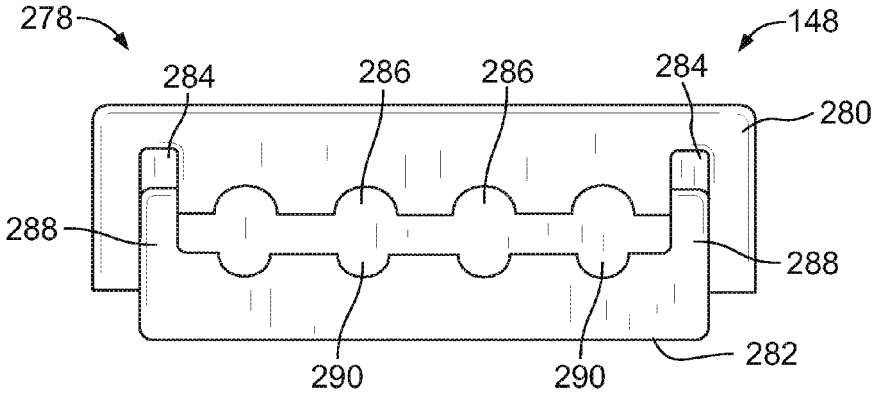
FIG. 15 is a front view of a cable terminator formed in accordance with an embodiment and in an open configuration.

FIG. 15 illustrates the cable terminator 148 in an open configuration 278. The cable terminator 148 includes a housing 280 and a stuffer 282. The stuffer 282 is configured to be received within the housing 280. The housing 280 includes slots 284. The slots 284 are configured to receive the stuffer 282. Recesses 286 are formed in the housing 280 between the slots 284. The recesses 286 are configured to receive the conductive pathways 106 of the cable 104. The stuffer 282 includes flanges 288. The flanges 288 are configured to be received within the slots 284 of the housing 280. Recesses 290 are formed in the stuffer 282 between the flanges 288. The recesses 290 of the stuffer 282 align with the recesses 286 of the housing 280. The recesses 290 are configured to receive the conductive pathways 106 of the cable 104.

Figure 16:
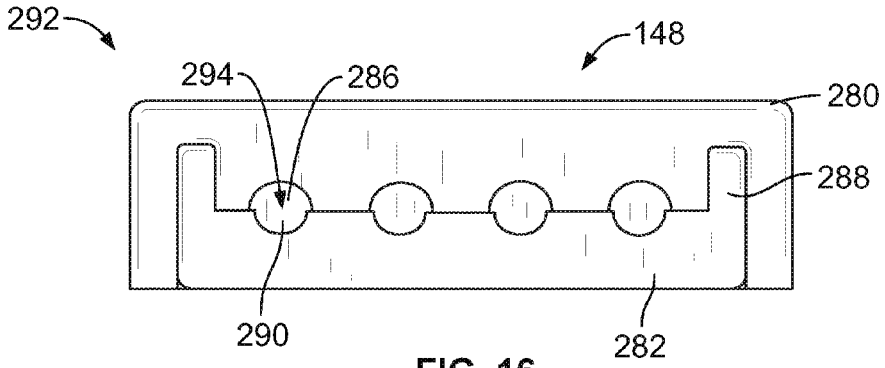
FIG. 16 is a front view of the cable terminator shown in FIG. 15 and in a closed configuration.

FIG. 16 illustrates the cable terminator 148 in a closed configuration 292. In the closed configuration 292, the stuffer 282 is slid into engagement with the housing 280. The flanges 288 of the stuffer 282 slide through the slots 284 of the housing 280 to form the cable terminator 148. The stuffer 282 engages the housing 280 so that the recesses 286 of the housing 280 align with the recesses 290 of the stuffer 282 to form openings 294. The conductive pathways 106 of the cable 104 are received within the openings 294 to terminate the cable 104. The termination circuit 116 (shown in FIG. 1) is housed within the cable terminator 148. The termination circuit 116 couples the power pathways 108 to the return pathways 110 to complete a circuit for the electrical current running through the cable 104.

Figure 17:
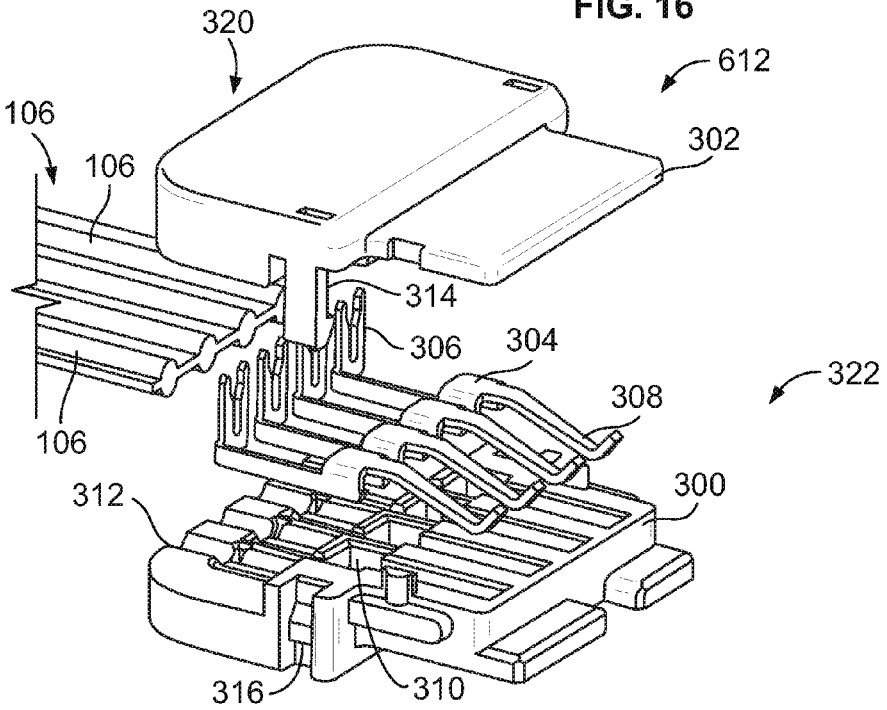
FIG. 17 is an exploded view of a second connector of a wire-to-wire plug assembly formed in accordance with an embodiment.

FIG. 17 illustrates an exploded view of the second connector 152 of the wire-to-wire plug assembly 146. The second connector 152 includes a cable end 320 and a mating end 322. The second connector 152 includes a housing 300, a stuffer 302, and an electrical contact 304. The housing 300 is configured to couple to the stuffer 302. The electrical contact 304 is configured to be housed within the second connector 152 between the housing 300 and the stuffer 302. The electrical contacts 304 include a cable contact 306 and a mating contact 308. The mating end 322 of the housing 300 includes slots 310 that receive the electrical contacts 304 therein. The cable end 320 of the housing 300 includes recesses 312 configured to receive the conductive pathways 106 of the cable 104. The electrical contacts 304 are positioned so that the cable contacts 306 rest within the recesses 312.

The stuffer 302 includes a latch 314 that is configured to engage a notch 316 formed on the housing 300 to mate the stuffer 302 to the housing 300. The stuffer 302 also includes recesses (not shown) that correspond to the recesses 312 formed in the housing 300. The recesses 312 formed in the housing 300 and the recesses formed in the stuffer 302 receive the conductive pathways 106 of the cable 104 so that the cable contacts 306 pierce the cable 104 and engage the conductive pathways 106.

Figure 18:
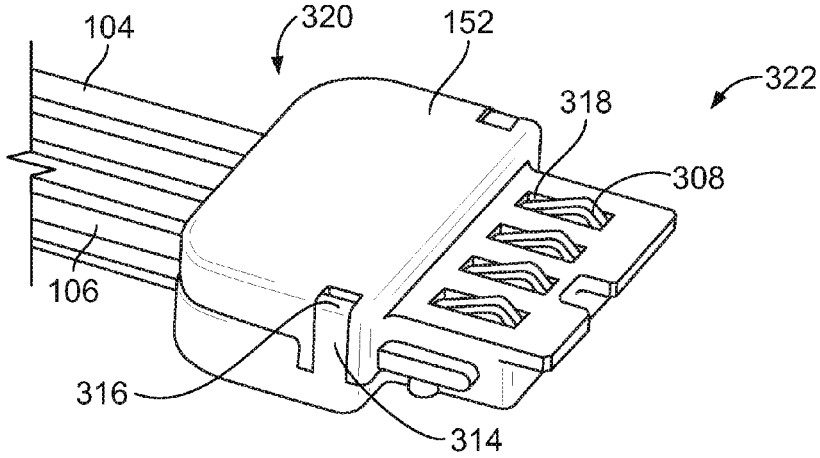
FIG. 18 is a top perspective view of the second connector, shown in FIG. 17.

FIG. 18 illustrates the second connector 152 coupled to the cable 104. The latch 314 of the stuffer 302 is secured to the notch 316 formed in the housing 300. The cable 104 is secured to the cable end 320 of the connector 152. The conductive pathways 106 are positioned within openings (not shown) formed by the recesses 312 of the housing and the corresponding recesses of the stuffer 302. The cable contacts 306 engage the conductive pathways 106 of the cable 104 to direct the electrical current to the mating contacts 308. The mating contacts 308 extend from openings 318 formed in the mating end 322 of the second connector 152. The mating contacts 308 are configured to engage corresponding contacts on the first connector 150 of the wire-to-wire plug assembly 146. Alternatively, the mating contacts 308 may directly engage a LED board 124.

Figure 19:
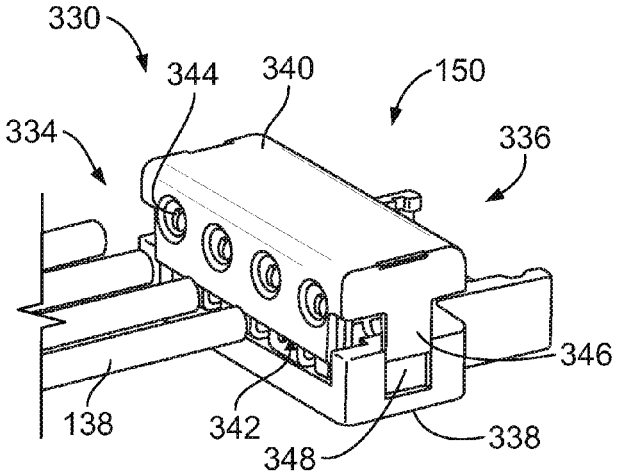
FIG. 19 is a top perspective view of a first connector of the wire-to-wire plug assembly formed in accordance with an embodiment.
Figure 20:
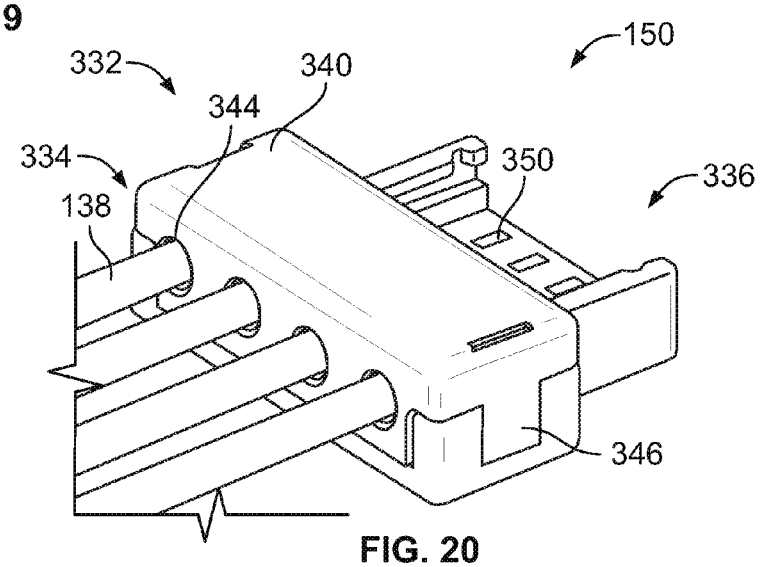
FIG. 20 is a top perspective view of the first connector, shown in FIG. 19.

FIG. 19 illustrates the first connector 150 of the wire-to-wire plug assembly 146 in a pre-assembled position 330. FIG. 20 illustrates the first connector 150 in an assembled position 332. The first connector 150 includes a wire end 334 and a mating end 336. The first connector 150 has a housing 338 and a stuffer 340. The housing 338 includes wire contacts 342. The wire contacts 342 are electrically coupled to mating contacts 350 (shown in FIG. 18) that extend along the mating end 336 of the housing 338. The stuffer 340 includes openings 344 that are aligned with the wire contacts 342. The openings 344 are configured to receive the wires 138 extending from the driver 102. A latch 346 extends from the stuffer 340. The latch 346 is configured to engage a notch 348 formed on the housing 338.

In the assembled position 332, the latch 346 of the stuffer 340 engages the housing 338 to join the housing 338 to the stuffer 340. The wires 138 are positioned within the opening 344 formed in the stuffer 340. When the stuffer 340 is coupled to the housing 338, the wires 138 are forced against the wire contacts 342. The wire contacts 342 pierce the wires 138 to direct the electrical current from the wires 138 to the mating contacts 350. The mating end 336 of the first connector 150 is configured to engage the mating end 322 of the second connector 152. When the first connector 150 is coupled to the second connector 152 the mating contacts 308 of the second connector 152 engage the mating contacts 350 of the first connector 150. The first connector 150 and the second connector 152 engage to direct the electrical current from the wires 138 to the cable 104.

Figure 21:
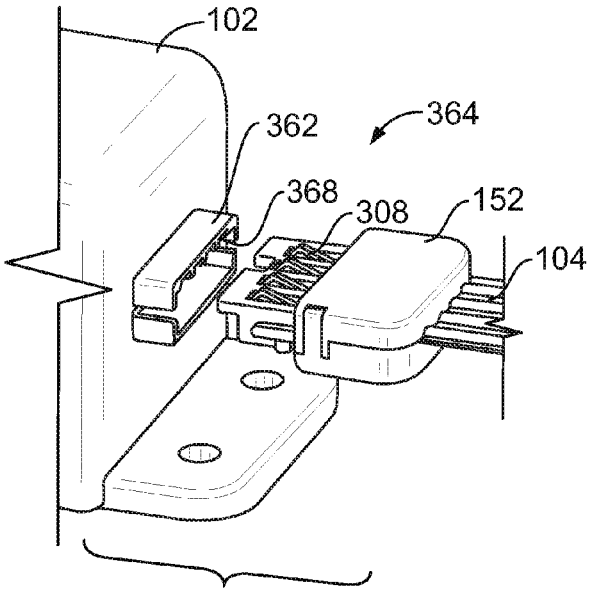
FIG. 21 is a top perspective view of a wire-to-board assembly formed in accordance with an embodiment.
Figure 22:
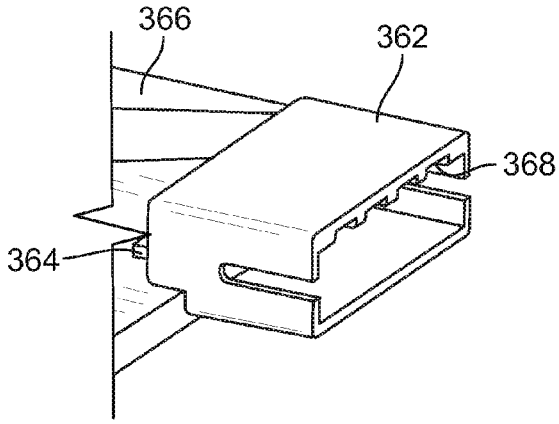
FIG. 22 is a top perspective view of a plug formed in accordance with an embodiment.

FIG. 21 illustrates a wire-to-board assembly 361 formed in accordance with an embodiment and that may be used with the system 100. The wire-to-board assembly 361 incorporates the second connector 152. The wire-to-board assembly 361 enables the second connector 152 to be coupled directly to the driver 102. The wire-to-board assembly may eliminate the need for the wires 138. The wire-to-board assembly 361 includes a plug 362 that is joined to the driver 102. As illustrated in FIG. 20, the plug 362 includes a circuit board contact 364. The circuit board contact 364 is joined to a circuit board 366 (shown in FIG. 22) of the driver 102. The circuit board 366 generates the electrical current to power the LEDs 128. The plug 362 includes mating contacts 368. The second connector 152 is configured to be received within the plug 362. The mating contacts 308 of the second connector 152 engage the mating contacts 368 of the plug 362 to direct the electrical current to the cable 104.

Figure 23:
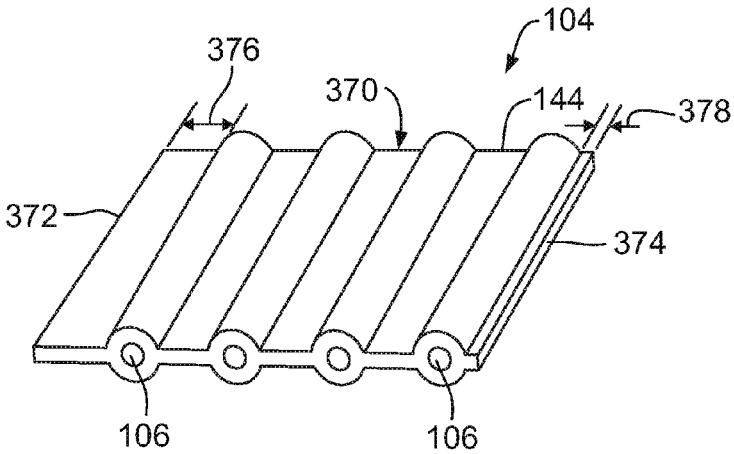
FIG. 23 is a top perspective view of a cable formed in accordance with an embodiment.

FIG. 23 illustrates the cable 104. The conductive pathways 106 extend through the cable 104. The illustrated embodiment shows four conductive pathways 106. Alternatively, the cable 104 may include only two conductive pathways 106 or more than four conductive pathways 106. The number of conductive pathways 106 corresponds to a number of components attached to the cable 104. Each component requires a power pathway 108 and a return pathway 110. Optionally, the cable 104 may also include ground pathways. The conductive pathways 106 are covered and protected by the insulation 144.

The conductive pathways 106 are separated by spacers 370 formed in the insulation 144. The conductive pathways 106 are illustrated having equal spacing. Alternatively, the spacing between the conductive pathways 106 may vary. The insulation 144 includes a first polar flap 372 and an opposite second polar flap 374. The first polar flap 372 has a length 376 and the second polar flap 374 has a length 378 that differs from the length 376. The polar flaps 172 and 174 have different lengths 176 and 178, respectively, to align the cable 104 within the connectors 118. The polar flaps 172 and 174 align the cable 104 to ensure that the cable 104 is not inserted into the connectors 118 upside-down.

Figure 24:
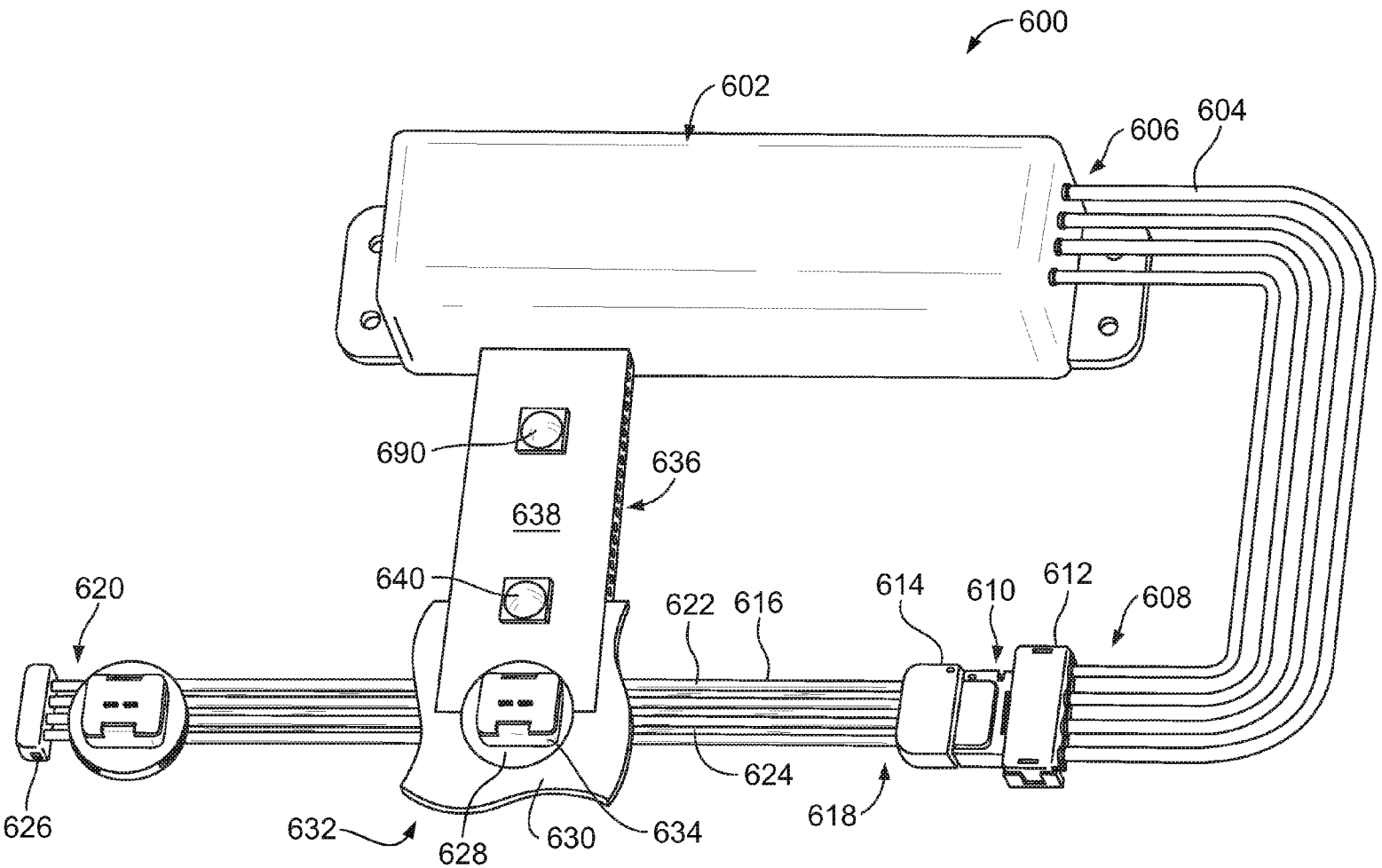
FIG. 24 is a top perspective view of another LED interconnection system formed in accordance with an embodiment.

FIG. 24 illustrates another LED interconnection system 600 for a solid state lighting system and formed in accordance with an embodiment. The system 600 includes a driver 602 that includes wires 604 extending therefrom. The driver 602 may include a circuit board that carries an electrical current throughout the system 600. The wires 604 are configured to carry the electrical current. The wires 604 include a driver end 606 and a mating end 608. The driver end 606 of each wire 604 is joined to the driver 606. The mating end 608 of each wire 604 is joined to a wire-to-wire plug assembly 610. The wire-to-wire plug assembly 610 includes a first connector 612 and a second connector 614. In an exemplary embodiment, the first connector 612 is configured as a jack and the second connector 614 is configured as a plug. Alternatively, the first connector 612 may be configured as a plug and the second connector 614 may be configured as a jack. The mating end 608 of each wire 604 is coupled to the first connector 612 of the wire-to-wire plug assembly 610. A cable 616 is electrically joined to the second connector 614. The second connector 614 engages the first connector 612 to mate the wires 604 with the cable 616.

The cable 616 includes a driver end 618 and a termination end 620. The driver end 618 of the cable 616 is joined to the second connector 614 of the wire-to-wire plug assembly 610. In the illustrated embodiment, the cable 616 is a ribbon cable having power pathways 622 and return pathways 624. The power pathways 622 carry the electrical current from the driver 602 to the termination end 620 of the cable 616. A cable terminator 626 is joined to the termination end 620 of the cable 616. The cable terminator 626 includes a termination circuit (not shown) that joins the power pathways 622 and the return pathways 624. The return pathways 624 carry the electrical current back to the driver 602 to complete an electrical circuit throughout the system 600.

At least one connector 628 is coupled to the cable 616 between the driver end 618 and the termination end 620 of the cable 616. In an exemplary embodiment, the connector 628 is an insulation displacement connector. The connector 628 is joined to a fixture panel 630. The connector 628 is coupled to the fixture panel 360 so that the cable 616 extends along an underside 632 of the fixture panel 630. When the connector 628 is joined to the fixture panel 630, the underside 632 of the fixture panel 630 and the wire 616 are not visible. The connector 628 includes a LED connector 634 that extends through an opening in the fixture panel 630.

A LED board 636 is coupled to the LED connector 634 of the connector 628. The LED board 636 includes a circuit board 638 having a LED 640 joined thereto. The LED board 636 electrically engages the connector 628 to provide power to the LED 640. The power pathways 622 carry power to the LED 640. The power pathways 622 are spliced within the connector to direct the electrical current to the LED 640. The electrical current then exits the LED 640 and is channeled back to the power pathway 622.

Figure 25:
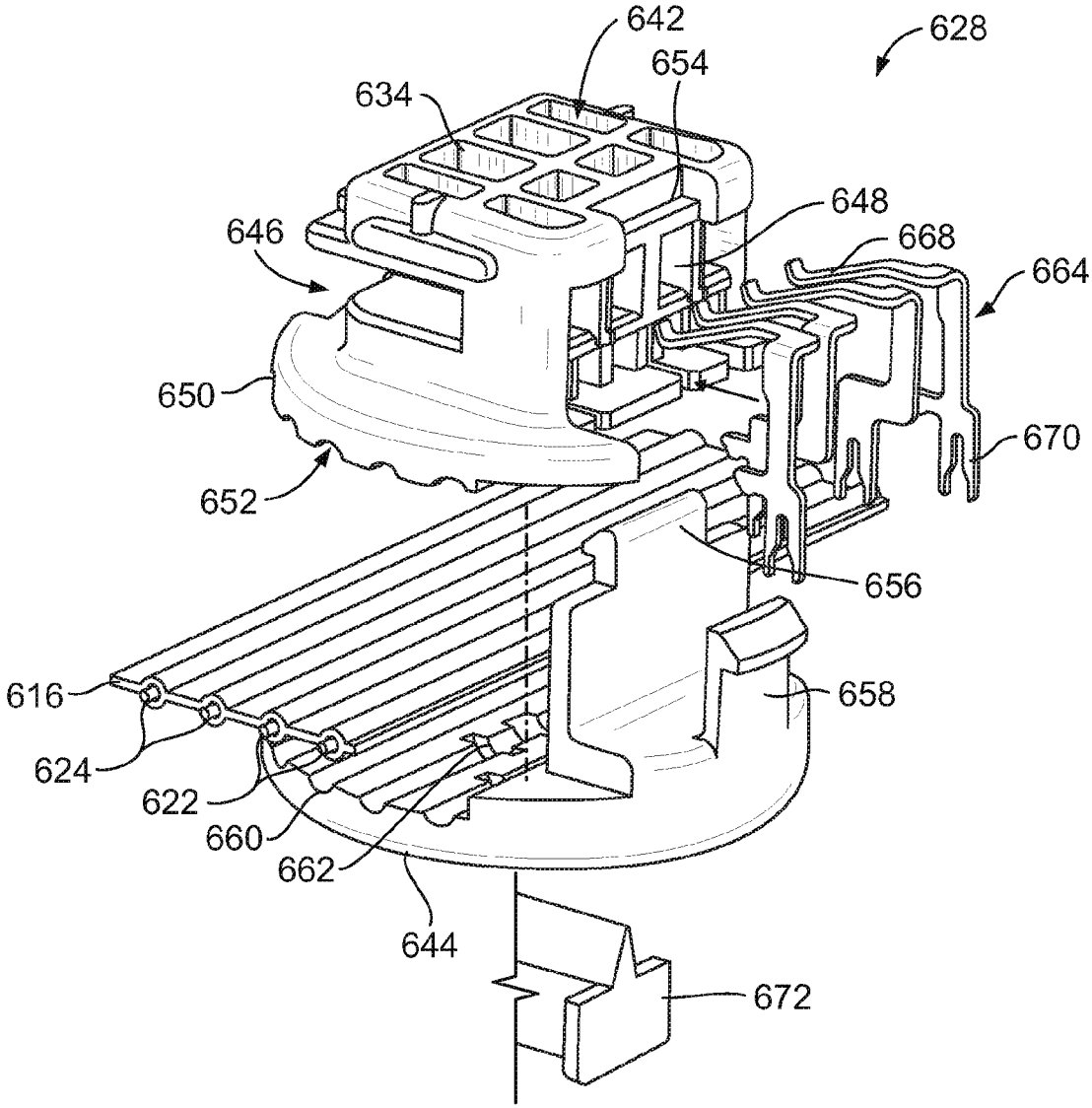
FIG. 25 is an exploded view of a connector formed in accordance with an embodiment and coupled to a cable.

FIG. 25 is an exploded view of the connector 628. The connector 628 includes a housing 642 and a stuffer 644. The housing 642 includes the LED connector 634 having a slot 646 formed therein. The slot 646 is configured to receive the LED board 636. A notch 654 is formed in the LED connector 634 and is configured to be engaged by the stuffer 644. Openings 648 are formed in the housing 642 opposite the slot 646. The housing 642 includes a cable connector 650 joined to the LED connector 634. The cable connector 650 includes recesses 652 that receive the power pathways 622 and the return pathways 624 of the cable 616.

The stuffer 644 includes a housing latch 656. When the housing 642 is joined to the stuffer 644 the housing latch 656 engages the notch 654 to mate the housing 642 and the stuffer 644. The stuffer 644 also includes a fixture latch 658 configured to engage the fixture panel 630. Recesses 660 are formed in the stuffer 644 and are configured to receive the power pathways 622 and the return pathways 624 of the cable 616. Slots 662 are formed in the recesses 660.

The connector 628 includes electrical contacts 664. The electrical contacts 664 include a LED contact 668 and a cable contact 670. The LED contacts 668 are configured to be inserted into the openings 648 formed in the housing 642. The LED contacts 668 extend through the openings 648 and into the slot 646. The LED contacts 668 are configured to engage the LED board 636. The cable contacts 668 extend toward the stuffer 644 and are configured to engage the power pathway 622 of the cable 616. The stuffer 644 includes a wire bisector 672 that is received through the stuffer 644 to splice the power pathways 622.

Figure 26:
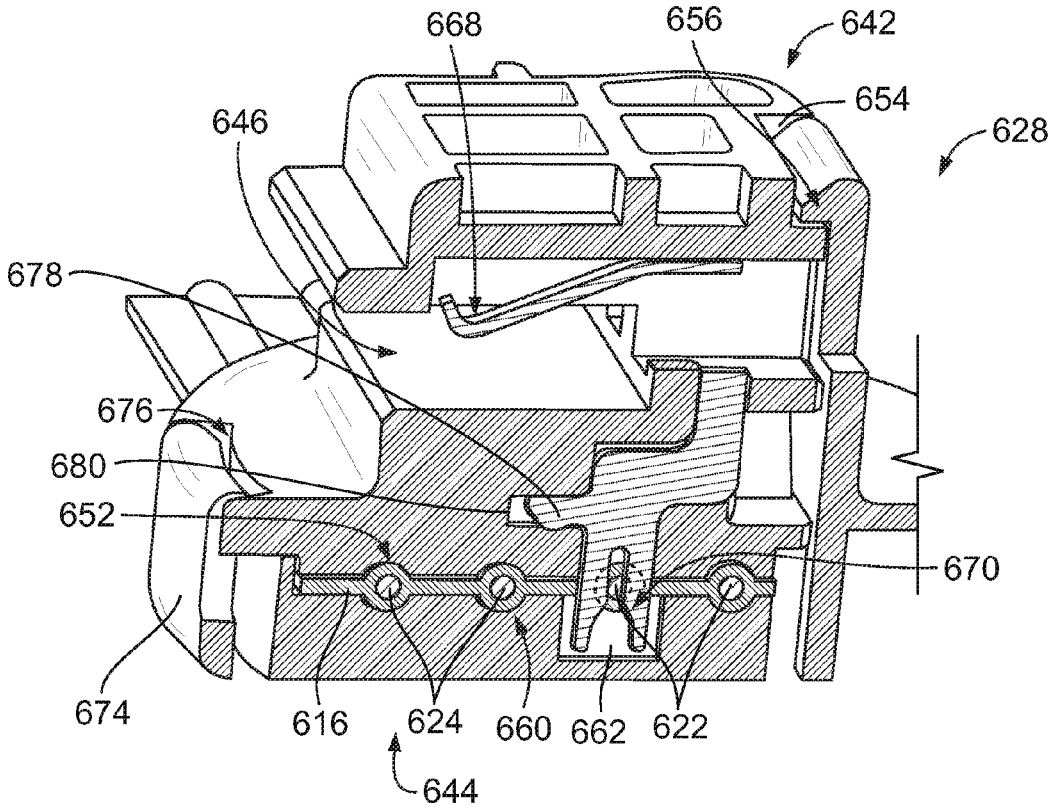
FIG. 26 is a cross-sectional view of the connector and the cable, shown in FIG. 25.

FIG. 26 is a cross-sectional view of the connector 628 coupled to the cable 616. The cable 616 is positioned between the stuffer 644 and the housing 642. The housing latch 656 of the stuffer 644 engages the notch 654 of the housing 642. Another housing latch 674 is provided on the stuffer 644 opposite the housing latch 656. The housing latch 674 engages a notch 676 formed on the housing 642. The latches 656 and 674 retain the stuffer 644 on the housing 642.

An alignment flange 678 extends from the electrical contact 664. The flange 678 is retained within a slot 680 formed in the housing 642. The flange 678 retains the electrical contact 664 within the housing 642. The LED contacts 668 extend into the slot 646 and are accessible to a LED board 636 inserted into the slot 646. The cable contact 670 extends into the stuffer 644 and is received within the slot 662.

The cable 616 is positioned between the housing 642 and the stuffer 644 so that the power pathways 622 and the return pathways 624 are positioned between the recesses 652 and 660. The cable contact 670 pierces the cable 616 and engages a power pathway 622. The cable contact 670 directs the electrical current between the power pathway 622 and the LED contact 668.

Figure 27:
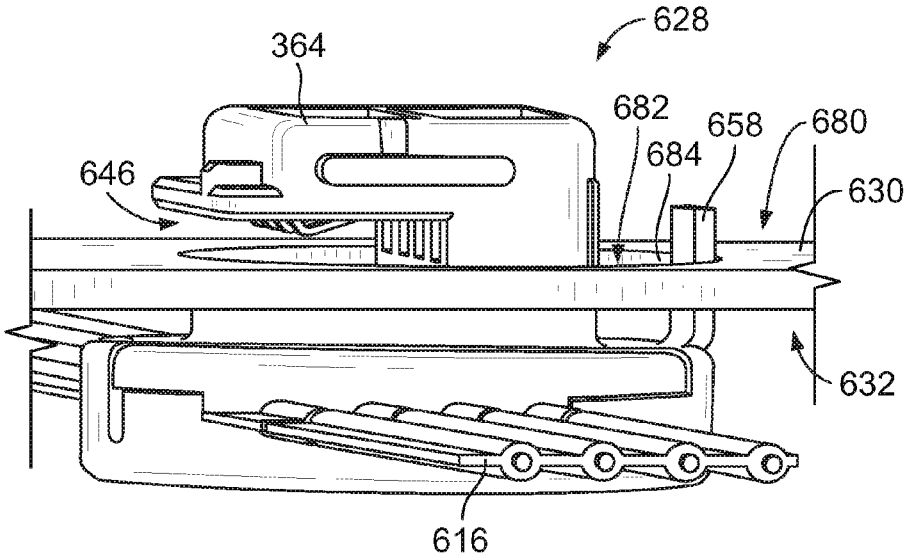
FIG. 27 is a side perspective view of a connector formed in accordance with an embodiment and coupled to a fixture.

FIG. 27 illustrates the connector 628 coupled to the fixture panel 630. The fixture panel 630 includes the underside 632 and a LED side 682. An opening 684 extends through the fixture panel 630. The connector 628 is inserted into the opening 684 and is retained by the fixture latch 658. The fixture latch 658 engages a side 686 of the opening 684 to retain the connector 628 within the fixture panel 630. The connector 628 is joined to the fixture panel 630 so that the cable 616 extends along the underside 632 of the fixture panel 630. When installed the cable 616 is not visible on the underside 632 of the fixture panel 630. The LED connector 634 is positioned on the LED side 682 of the fixture panel 630. The LED board 636 is configured to be inserted into the slot 646 so that the LED board is positioned on the LED side of the fixture panel 630.

Figure 28:
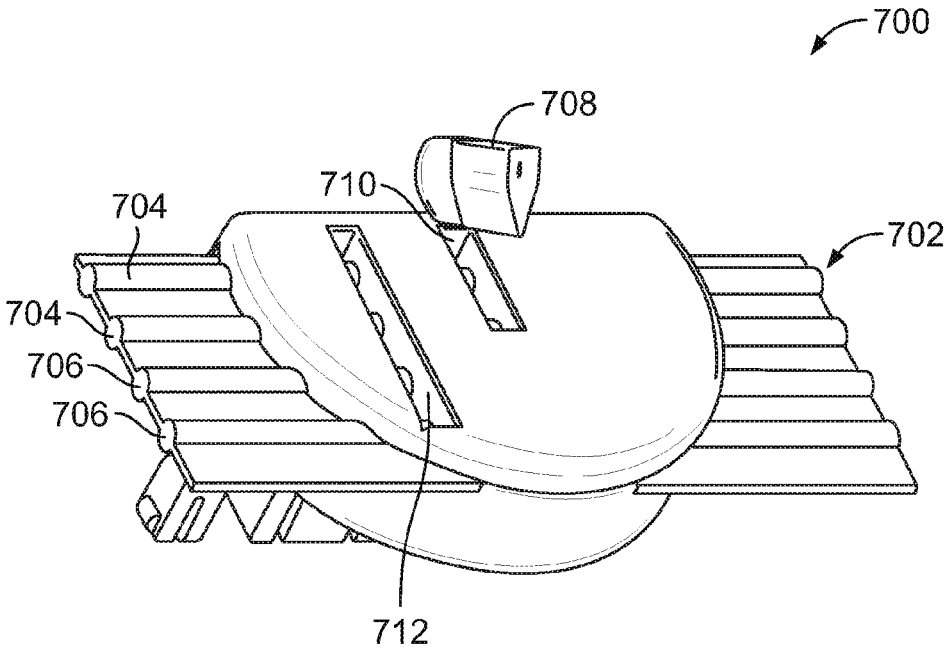
FIG. 28 is a top perspective view of an alternative cable terminator formed in accordance with an embodiment.
Figure 29:
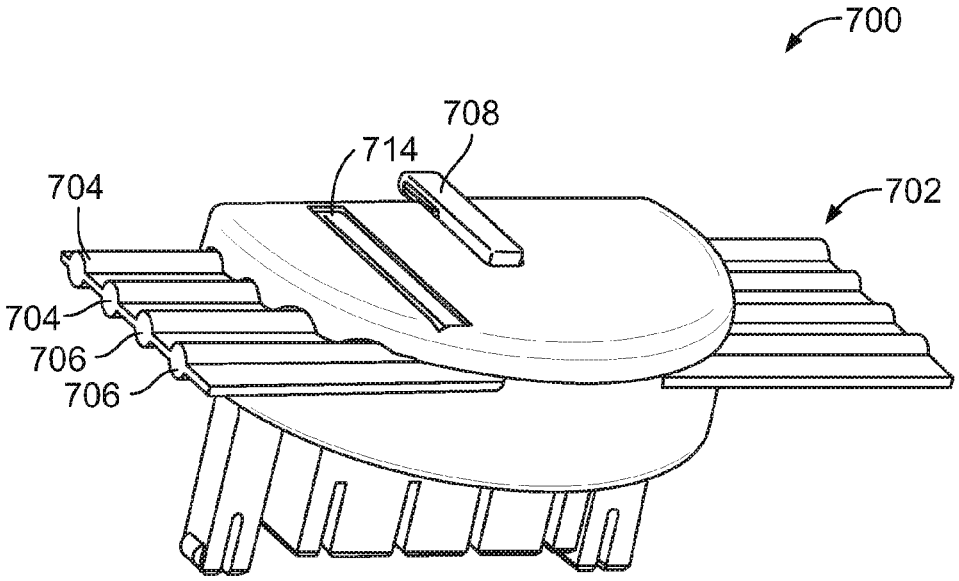
FIG. 29 is another top perspective view of the cable terminator, shown in FIG. 28.

FIG. 28 illustrates an alternative cable terminator 700 formed in accordance with an embodiment. FIG. 29 illustrates another view of the cable terminator 700. The cable terminator 700 functions both as a connector and a cable terminator. The cable terminator 700 receives a cable 702 having power pathways 704 and return pathways 706. The cable terminator 700 includes electrical contacts (not shown) that engage the power pathways 704 to provide power to a LED board (not shown). The power pathways 704 are spliced with a wire bisector 708 to direct an electrical current to the electrical contacts. The wire bisector 708 is configured to be received within a slot 710 that provides access to the power pathways 704.

A termination slot 712 is also provided in the cable terminator 700. The termination slot 712 provides access to both the power pathways 704 and the return pathways 706. A termination circuit 714 (shown in FIG. 27) is received within the termination slot 712. The termination circuit 714 couples the power pathways 704 to the return pathways 706 to complete a circuit. The cable terminator 700 terminates the cable 702 while also providing power to a LED board.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A light emitting diode (LED) assembly comprising:

a connector having a LED end and a cable end, the connector including electrical contacts having a cable contact and a LED contact, the cable contacts positioned on the cable end of the connector and configured to terminate a cable and electrically connect to a power pathway of the cable, the LED contacts positioned on the LED end of the connector;

a LED circuit board having circuit board contacts mounted to and positioned on an upper surface of the LED circuit board, the LED circuit board including a connector engagement mechanism mounted to and positioned on the upper surface of the LED circuit board, the circuit board contacts and the connector engagement mechanism positioned on an end of the upper surface of the LED circuit board with the connector engagement mechanism disposed on the upper surface of the LED circuit board around the circuit board contacts of the LED circuit board and configured to receive the LED end of the connector within the connector engagement mechanism, the connector engagement mechanism configured to engage the LED end of the connector so that the LED contacts of the connector electrically engage the circuit board contacts of the LED circuit board; and a LED mounted on the LED circuit board, the LED electrically coupled to the circuit board contacts of the LED circuit board, the circuit board contacts and the electrical contacts of the connector forming electrical pathways between the connector and the LED, a first electrical pathway configured to direct an electrical current from the power pathway of the cable to the LED, a second electrical pathway configured to direct the electrical current from the LED back to the power pathway of the cable.

2. The assembly of claim 1 further comprising a cable termination circuit configured to join the power pathways of the cable to return pathways of the cable.

3. The assembly of claim 1, wherein the LED end of the connector includes tabs that are accepted by slots of the connector engagement mechanism of the LED circuit board when the LED end of the connector is slid into the connector engagement mechanism in a direction substantially parallel to a plane defined by the LED circuit board.

4. The assembly of claim 1, wherein the LED circuit board includes a clip, the clip of the LED circuit board engaging the LED end of the connector.

5. The assembly of claim 1, wherein the connector includes a wire bisector configured to bisect the power pathways of the cable to separate the first electrical pathway and the second electrical pathway.

6. The assembly of claim 1, wherein the wire bisector includes a dielectric material to insulate the first electrical pathway from the second electrical pathway.

7. The assembly of claim 1, wherein the connector engagement mechanism of the LED circuit board is soldered to the LED circuit board.

8. A light emitting diode (LED) interconnection system comprising:

a cable having a driver end and a termination end, the cable having power pathways and return pathways extending between the driver end and the termination end, the driver end configured to engage a driver to carry an electrical current to the power pathways, the termination end configured to join the power pathways and the return pathways and configured to return the electrical current to the driver;

a connector having a cable contact and a LED contact joined to the cable contact, the cable contact terminating the cable and electrically connecting to the power pathways to carry the electrical current to the LED contact, wherein the connector includes a LED end, the LED contact extending from the LED end; and a LED assembly including a LED circuit board having circuit board contacts joined to a LED, the circuit board contacts mounted to and positioned on an upper surface of the LED circuit board, the LED assembly including a connector engagement mechanism mounted to and positioned on the upper surface of the LED circuit board, the circuit board contacts and the connector engagement mechanism positioned on an end of the upper surface of the LED circuit board with the connector engagement mechanism disposed on the upper surface of the LED circuit board around the circuit board contacts of the LED circuit board and configured to receive the LED end of the connector within the connector engagement mechanism, the connector engagement mechanism configured to engage the LED end of the LED connector to electrically connect the LED contact and the circuit board contacts of the LED assembly.

9. The system of claim 8 further comprising a cable terminator joined to the termination end of the cable, the cable terminator joining the power pathways to the return pathways and configured to direct the electrical current back to the driver.

10. The system of claim 8, wherein the connector includes a wire bisector configured to bisect the power pathways of the cable to direct the electrical current between the power pathways and the LED assembly.

11. The system of claim 8, wherein the connector engagement assembly is soldered to the LED circuit board.

12. The system of claim 8, wherein the LED end of the connector includes tabs that are accepted by slots of the connector engagement mechanism of the LED circuit board when the LED end of the connector is slid into the connector engagement mechanism in a direction substantially parallel to a plane defined by the LED circuit board.

13. The system of claim 8 further comprising a wire-to-wire plug assembly configured to join the cable to a wire extending from the driver.

14. The system of claim 8 further comprising a wire-to-board plug assembly configured to join the cable to a circuit board of the driver.

15. A light emitting diode (LED) interconnection system comprising:

a driver configured to produce an electrical current;

a cable having a driver end and a termination end, the cable having power pathways extending between the driver end and the termination end, the driver end engaging the driver to carry the electrical current to the power pathways;

a connector having a LED end and a cable end, the connector including electrical contacts having a cable contact and a LED contact, the cable contacts positioned on the cable end of the connector to terminate the cable and electrically connect to the power pathways of the cable, the LED contacts positioned on the LED end of the connector;

a LED circuit board a having circuit board contacts mounted to and positioned on an upper surface of the LED circuit board, the LED circuit board including a connector engagement mechanism mounted to and positioned on the upper surface of the LED circuit board, the circuit board contacts and the connector engagement mechanism positioned on an end of the upper surface of the LED circuit board with the connector engagement mechanism disposed on the upper surface of the LED circuit board around the circuit board contacts of the LED circuit board and configured to receive the LED end of the connector within the connector engagement mechanism, the connector engagement mechanism configured to engage the LED end of the connector so that the LED contacts of the connector electrically engage the circuit board contacts of the LED circuit board; and a LED mounted on the LED circuit board, the LED electrically coupled to the circuit board contacts of the LED circuit board, the circuit board contacts and the electrical contacts of the connector forming electrical pathways between the connector and the LED, a first electrical pathway directing the electrical current from the power pathway of the cable to the LED, a second electrical pathway directing the electrical current from the LED back to the power pathway of the cable.

16. The system of claim 15, wherein the driver includes a wire extending therefrom, the system further comprising a wire-to-wire plug assembly configured to join the cable to the wire extending from the driver.

17. The system of claim 15, wherein the driver includes a circuit board, the system further comprising a wire-to-board plug assembly configured to join the cable to the circuit board of the driver.

18. The system of claim 15, wherein the LED end of the connector includes tabs that are accepted by slots of the connector engagement mechanism of the LED circuit board when the LED end of the connector is slid into the connector engagement mechanism in a direction substantially parallel to a plane defined by the LED circuit board.

19. The system of claim 15, wherein the connector includes a wire bisector configured to bisect the power pathways to direct the electrical current between the power pathways to the LED circuit board.

* * * * *